United States Patent [19]

Cornell

[11] 4,287,694

[45] Sep. 8, 1981

[54] CORNER JOINT FORMATION FOR BUILDING LOG

[76] Inventor: G. Howard Cornell, 4315 Villa Crescent NW., Calgary, Alberta, Canada

[21] Appl. No.: 58,412

[22] Filed: Jul. 17, 1979

[51] Int. Cl.[3] ..... E04B 1/10

[52] U.S. Cl. ..... 52/233; 52/394

[58] Field of Search ..... 52/233, 403, 394

[56] References Cited

U.S. PATENT DOCUMENTS

| | | | |
|---|---|---|---|
| 2,563,703 | 8/1951 | Bonney | 52/233 |
| 2,712,678 | 7/1955 | Jensen | 52/233 |
| 3,257,762 | 6/1966 | Steiner | 52/233 |
| 4,126,977 | 11/1978 | Chisum | 52/396 X |

FOREIGN PATENT DOCUMENTS

| | | | |
|---|---|---|---|
| 617935 | 4/1961 | Canada | 52/233 |
| 968921 | 6/1975 | Canada | 52/233 |
| 2309878 | 8/1974 | Fed. Rep. of Germany | 52/233 |

*Primary Examiner*—Carl D. Friedman

*Attorney, Agent, or Firm*—Beveridge, DeGrandi, Kline & Lunsford

[57] ABSTRACT

A corner joint formation for pre-shaped building logs of the type in which the flanks of a notch in the top of one log fit against the sides of a neck formed by a notch in another log forming a corner with the first log, wherein the mating side faces of the neck and notch are tapered so as to fit closely together when the logs are fully engaged. The tapered flank faces of the notch stand proud of an outer shoulder which conforms closely to the outline sectional shape of the mating log and forms an interference fit with a similar shoulder of this mating log. The neck of the joint formation is preferably ridged to inhibit flow of water across the joint, and in addition a weather strip may project from the upper edge of the neck ridge to inhibit flow of air across the joint.

3 Claims, 3 Drawing Figures

CORNER JOINT FORMATION FOR BUILDING LOG

Figure 1:
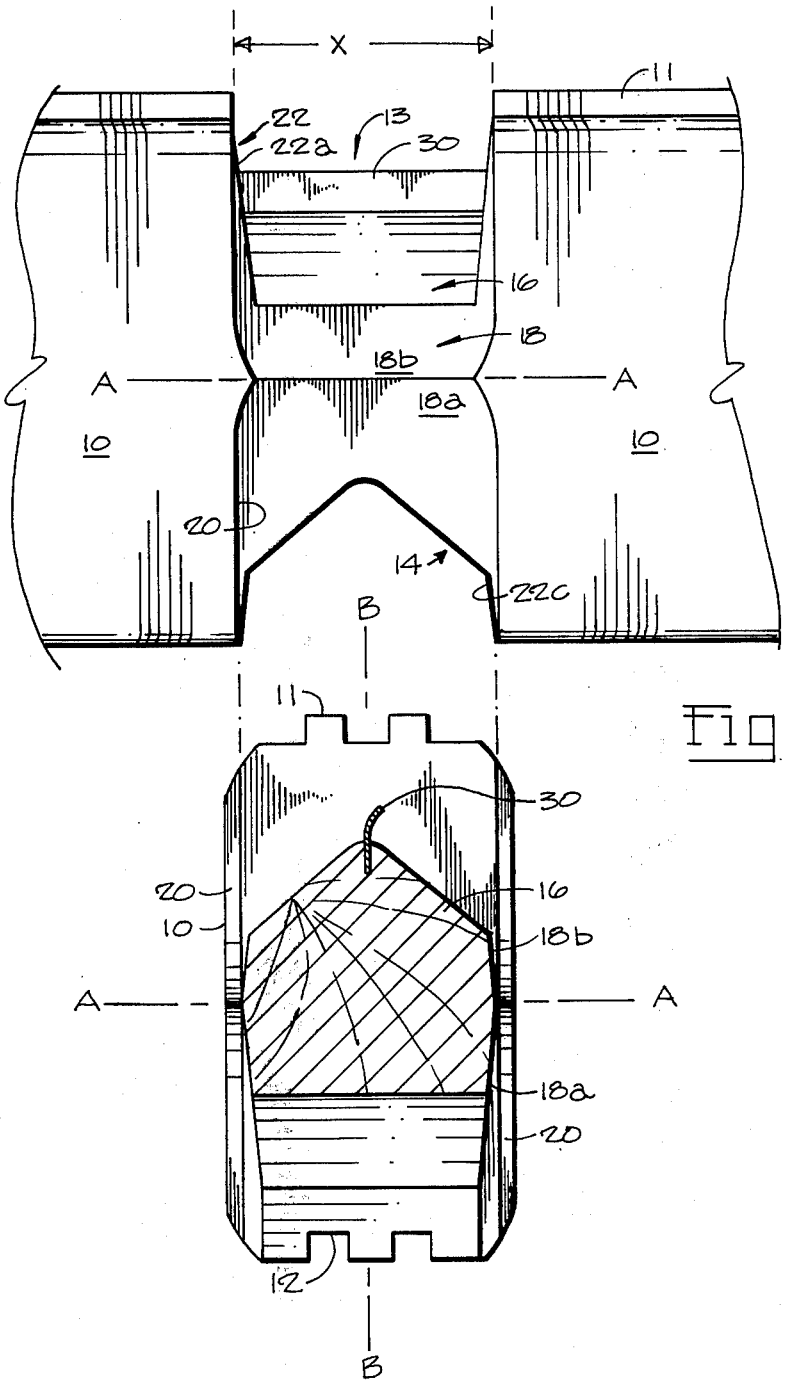

The present invention relates to a corner joint formation for an elongated preformed building member of the type formed partly or wholly of wood, and used in the construction of log type buildings. Such a building member may be of solid timber, but advantageously the member may be a laminate of outer layers of wood with a central layer of insulating plastic foam material, such composite members being lighter and having better insulating properties, than solid wood logs. A building member of this general kind, whether solid wood or laminate, will be hereinafter referred to as a "log".

Various designs of corner joints for logs have been made or proposed, for example as in the following Canadian Pat. Nos.

491,373 issued Mar. 17, 1953 to Jensen
645,222 issued July 24, 1962 to Ipsen
691,689 issued Aug. 4, 1964 to Jeppesen
738,652 issued July 19, 1966 to Steiner
968,921 issued June 10, 1975 to Bain One commonly used design is similar to that shown in the above-mentioned Jeppesen patent. In this, the log has notches in its upper and lower edges which define a central neck, and the neck has a central ridge which inhibits flow of water across the joint so that even if the joint is not completely tight rainwater does not tend to seep through due to the upward slope presented by the ridge. Since this joint formation is intended to be identical for the two crossing logs, the underside of the neck has a V-shaped recess which receives the ridged neck of the mating log. In a joint of this kind the neck may be slightly shorter than the width of the log so that there is an interference fit between the outer vertical corners of the notches as these engage with each other, with the neck being preferably recessed at its side surfaces to avoid interference on these surfaces. This kind of interference fit in a log joint is the subject of the above-mentioned patent to Jensen. In a log joint having an interference fit of this kind, the upper and lower margins of the side surfaces of the log are preferably tapered or rounded inwardly, and, as described in the above-mentioned Steiner patent, outer areas or shoulders of the notch flanks, which continue in the form of shoulders down to the horizontal medial plane of the log, are shaped to conform to the cross-sectional outline of the mating log and may be set back relative to the main central areas of the notch flanks. The wood in these shoulders becomes impacted as the logs are driven together.

In all of these joint constructions of the prior art, the flanks of the notch and the adjacent surfaces of the neck portion extend perpendicularly to the horizontal medial plane of the log, and there is a clearance space between these surfaces when the joint is completed. Some clearance is required in these prior art designs since wood changes its dimensions slightly on drying, and the logs may also twist slightly so that precise fitting is not possible. The presence of such clearances has two results i.e.:

(1) When a joint is formed the only surfaces of the two logs in firm contact are the above-described interfering shoulders. Depending on small variations in the wood strength or dimensions, impaction may take place unevenly at one side or the other of the notch, so that when joints between the logs of two adjoining walls have been completed the end surfaces of the logs of each wall will not be in exact alignment, leaving an untidy appearance.

(2) It is possible for cold air to flow through the joint since the uneveness of the impaction and slight twisting of one log relative to another means that the impacted joints are not reliably air tight.

The present invention provides a joint which gives a close fit between the adjacent surfaces of the neck portion and notches and thus gives improved end-to-end alignment of logs of one wall and reduced air flow through the joint.

In accordance with a broad aspect of the present invention, in a building log joint formation for making a corner joint with a similar log, of the type including a neck joining parts of the log on opposite sides of a notch in the upper edge of the log, and in which the neck has side surfaces recessed within the side faces of the log, the notch being surrounded by an outer shoulder; flank areas of the notch within the outer shoulders are sloped at a small angle from the perpendicular to the log axis so as to converge downwardly, and the neck side surfaces adjoining said notch also slope at a similar small angle relative to a vertical medial plane of the logs so as to diverge downwardly giving a maximum neck width at the level of the base of the mating log when engaged in the joint formation, whereby said converging surfaces of the flanks and diverging surfaces of the neck sides can mate with similarly sloping neck and flank surfaces of the mating log.

The present invention will be described in relation to a joint formation of the general type described in the above-mentioned Jeppesen and Steiner patents, which joint formation is intended to mate with an identical joint formation in another log. For this purpose, notches are formed in both the upper and lower edges of the log, the flanks of each converging towards the centre of the log, and the neck side surfaces converge upwards and downwards from the horizontal medial plane of the log. However the tapering notch flanks, and sloping side surfaces of the neck portion of this invention, can equally be used in other joint configurations for example that of the above-mentioned Ipsen and Bain patent.

The present invention also provides means for sealing the spaces between the surfaces of adjacent log necks to further prevent air flow through the joint.

Figure 3:
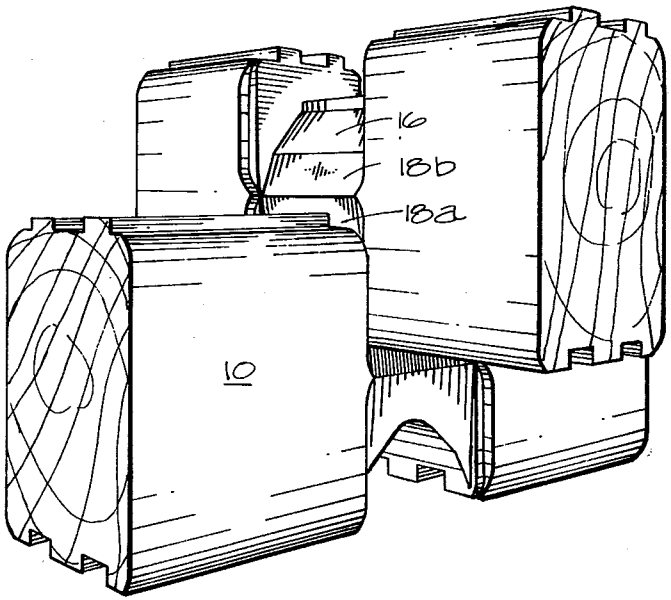
Figure 2:
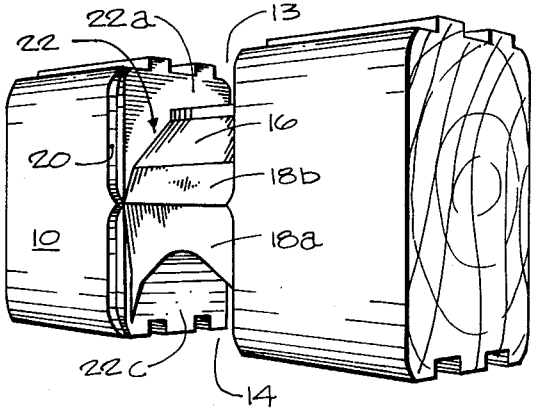

A preferred embodiment of the present invention will now be described with reference to the accompanying drawings, in which:

FIG. 1 shows a view of two identical logs having joint formations of this invention at right angles to each other before being mated together to form a joint, the joint formation of one log being shown in side elevation and of the other log in cross-sectional view, FIG. 2 shows a perspective view of the joint formation, and FIG. 3 shows a perspective view of the joint formation as engaged with a half-log to form the base of a wall corner.

Referring to the drawings, the log is of generally rectangular shape having generally flat sides 10 and having upper and lower edges with complementary tongues 11 and grooves 12, the upper and lower margins of the side faces being rounded inwardly towards the upper and lower edges for a purpose to be described.

The joint formation includes upper and lower notches 13 and 14 respectively, which define between them a connecting portion or neck 16 of reduced cross-section. As seen in the lower part of FIG. 1, the cross-sectional shape of the neck 16 includes a central ridge which inhibits flow of water across the joint. In order that the joint can mate with an identical joint formation, the lower part of the neck portion is provided with a V-shaped recess as shown in the upper part of FIG. 1.

The maximum width of the notch, indicated at "X" in FIG. 1, is slightly less than the overall width of the log, and to allow the two logs to mate together without undue forcing the side surfaces 18 of the neck portion are recessed relative to the side surfaces 10 of the logs, being joined thereto by vertical shoulders 20 which are spaced apart the distance "X" (i.e. the maximum notch width) and continue to the upper and lower edges of the log. The shoulders 20, as viewed in elevation, have a configuration which matches the cross-sectional outline of the log, but which is slightly narrower than the overall width of the log so that when the logs are jointed together there is an interference fit between the shoulders of one log and that of the next causing impacting of the wood at the shoulders. The manner in which this jointing is achieved is assisted by the converging upper and lower margins of the log, this convergence being reflected in the shape of the shoulders, the manner in which these parts fit together being similar to that described in the above-mentioned Steiner patent.

The shoulders 20, above and below the neck, are set back relative to the main areas of the flanks or side surfaces 22 of the notches. In accordance with one feature of the invention, at least an upper portion 22*a* of these flanks is tapered at a small angle to the perpendicular to the axis or more strictly to the plane normal to the central horizontal axis of the log. This taper is such that the facing surfaces 22*a* of the upper notch converge downwardly, and likewise the facing surfaces 22*c* of the lower notch converge upwardly at a similar angle. The flank portions 22*a* of an upper notch will mate with the lower side surfaces 18*a* of the neck of a next upper log, and in accordance with a further feature of the invention these neck surfaces at least near the horizontal medial plane A—A are sloped at a similar small angle to the vertical medial plane of the log i.e., plane B—B of FIG. 1 and are such as to converge downwardly from medial plane A—A. Also, the upper side surfaces 18*b* of the neck are sloped at a similar small angle relative to the vertical medial plane such as to converge upwardly from the horizontal medial plane A—A, so that the horizontal medial plane is the widest part of the neck. Accordingly, when the logs are jointed one with the other, a tight fit is provided between the mating surfaces of the neck and the notch flanks, inhibiting air flow. Also, these tapering surfaces guide one log relative to the other so that the ends of logs of one wall are all properly aligned. The fit between the flanks and neck sides may in fact be a slight interference fit since the taper will still allow the logs to be driven together.

The angle of convergence of the flanks 22*a*, and of surfaces 22*c*, and of the lower and upper neck surfaces 18*a* and 18*b*, is such that flanks 22*a* for example are displaced from shoulders 20 by an amount of about $\frac{1}{4}''$ to 3/16" (6 mm to 9 mm) at the lowermost ends of these surfaces 22*a* which ends will be about $2\frac{1}{2}''$ (63 mm) below the top of the log. The remaining surfaces 22*c*, 18*a* and 18*b* have similar angles of slope relative to the vertical.

It is not required that the whole of surface 22*a* be sloping, and a lower portion of this may be in a vertical plane.

In this joint, as in prior art joints, a clearance is provided between the ridge of the neck of one log and the V-shaped recess of the next lower log, this being necessary so that the joints between edges of logs of the same wall do not open up as the wood shrinks. In order to obtain even more effective sealing of the joint of this invention, in accordance with a further feature, a weather strip 30, for example a strip of extruded aluminum, is inserted into a narrow slot in the top of the ridge of the neck. This is deformed when the upper log is in place, and forms a tight seal therewith. Accordingly, the final joint has a tight seal provided between the side surfaces of the neck and the flanks, and between the top of one neck portion and the base of the next.

I claim:

1. In a building log having opposed side faces and upper and lower horizontal edges;

a joint formation for making a corner joint with an identical joint formation of a mating log, said formation including a neck joining parts of said log on opposite sides of notches in the upper and lower edges of said log, said neck being in part defined by said notches and in part by side surfaces recessed within the side surfaces of the log, and said notches being surrounded by an outer shoulder, wherein flank areas of the notches within said outer shoulders are sloped at a small angle from a plane normal to the log axis so as to converge towards the centre of the log, and the neck side surfaces adjoining said notches also slope at a similar small angle to a vertical medial plane of the log so as to converge upwardly and downwardly from a horizontal medial plane of the log, whereby said converging surfaces of the flanks and neck sides can mate with similarly sloping neck and flank surfaces of said mating log, and wherein the top and bottom of said neck are arranged to provide a clearance space with the adjacent parts of said mating log when fitted together.

2. A log according to claim 1 wherein said neck has a top surface which slopes downwardly towards one side surface of said neck for inhibiting flow of water across said neck.

3. A log according to claim 1 wherein said neck has projecting from the top thereof a flexible sealing strip extending substantially the length of said neck, said sealing strip being formed from a length of flat flexible material having one edge portion located in a slot in said neck, said neck and sealing strip being proportioned so that the top of said strip is an interference fit with an unslotted area of the neck of said mating log when mounted over the first-mentioned neck.

* * * * *